United States Patent [19]

Sterling

[11] Patent Number: 4,795,160

[45] Date of Patent: Jan. 3, 1989

[54] STRATEGY GAME UTILIZING BOARDS AND CARDS

[76] Inventor: Willard C. Sterling, 252 Denbigh Blvd., Newport News, Va. 23602

[21] Appl. No.: 33,670

[22] Filed: Apr. 3, 1987

[51] Int. Cl.[4] ..... A63F 3/06

[52] U.S. Cl. ..... 273/269

[58] Field of Search ..... 273/269, 270

[56] References Cited

U.S. PATENT DOCUMENTS

| | | | |
|---|---|---|---|
| 1,723,377 | 8/1929 | Salomon | 273/269 |
| 3,189,350 | 6/1965 | Hopkins | 273/153 R |
| 3,549,150 | 12/1970 | Weeks | 273/269 |
| 4,046,382 | 9/1977 | Ratzkoff | 273/269 |

FOREIGN PATENT DOCUMENTS

| | | | |
|---|---|---|---|
| 872703 | 7/1961 | United Kingdom | 273/269 |

*Primary Examiner*—Anton O. Oechsle
*Attorney, Agent, or Firm*—Joseph J. Zito

[57] ABSTRACT

A combination board and card game to be played by a number of players, wherein each player has an individual board and an individual card pool. The individual card pools are comprised of a number of cards from the primary card deck. Each board has a number of circular spaces arranged in a continuous pattern. Each player attempts to be the first player to cover all of the spaces on his board. Players establish a six-card hand from their individual card pool and then, in turn, play cards from their hand to indicate which spaces may be covered by chips. A player may play cards from his hand in combination with a card or cards which are lying face up for use by all players. Upon covering all of the spaces on a player's board, the player may draw one card from a secondary deck, to determine if he has won the current round, or if he must remove chips from his board and continue play. At the completion of each round points are awarded to the player who has covered all the spaces on his board. The number of points awarded is dependent upon the cards and uncovered spaces remaining in the possession of all players.

7 Claims, 6 Drawing Sheets

STRATEGY GAME UTILIZING BOARDS AND CARDS

BACKGROUND OF THE INVENTION

The present invention relates to games combining skill with luck. More particularly, the present invention relates to games utilizing a multiplicity of boards and cards.

There are numerous games of various skill levels, which utilize either boards or cards. There are also games which utilize both cards and boards in a combined play manner. The game taught in Ladd U.S. Pat. No. 3,948,524, utilizes a single board and a multiple number of markers. A deck of cards is also required to indicate to the players where to position the markers on the game board. U.S. Pat. No. 3,949,993 to Gerina teaches a game which utilizes boards, playing cards, and numbered chips. This game is played by drawing numbered and lettered chips and placing them on the appropriate corresponding spaces. U.S. Pat. No. 3,618,951 to Patrick teaches a bingo-like game, wherein a spinner is utilized to designate the spaces on the game boards to be covered.

The Tallarida U.S. Pat. No. 3,618,952 teaches a game utilizing one or more boards with identifiable spaces, wherein a mathematical-based selection system is utilized to determine which spaces are covered by which players at a given time.

U.S. Pat. Nos. 3,589,729 to Gerard and 3,549,150 to Leeks teach games wherein spaces identified by number and color are selectively covered. Gerard uses a series of three spinners to determine the covering of selected spaces. Leeks utilizes the roll of a set of dice to determine the selected covering of spaces. None of the above inventions teach the unique aspects of the present invention, which combines skill and luck on the part of each player in order to enable him to be the first to fill all of the places on his individual board.

SUMMARY OF THE INVENTION

The present invention is comprised of game boards, cards, and a method of competitive play for utilization of the cards and game boards. Two decks of cards, a primary deck and a secondary deck, are utilized by the present invention. The number of cards in the primary deck is dependent upon the number of game players. The present invention can be played by any number of players as long as sufficient game pieces are available.

Each player requires an individual board, and there must be a sufficient number of cards in the primary deck in order to be able to distribute the primary deck among the players, creating individual card pools of betweeen approximately 20 and 40 cards each. Generally, two to six players will play the game. At the beginning of play, each player is provided with his individual board. First, six cards are placed face up to form the common card pool and all the remaining cards in the primary deck are distributed to create an individual card pool for each player. Each player then draws six cards from his individual card pool.

The indicia on the front face of the cards corresponds to one or more of the numbered or distinctly-colored circles on the individual's game board. The players, in turn, utilize the cards from their hand and/or the common card pool, to determine which spaces on their individual playing board may be covered during their turn.

Play begins with a first player playing either a card from his hand or from the common card pool. When a card is played, the player removes a chip from the chip reservoir and places the chip upon the corresponding space on his individual game board. The player's turn then continues with the covering of adjacent spaces available to him through possession of corresponding cards in his hand or in the common card pool. Upon completion of his turn, the player may elect to replenish his hand from his individual card pool, up to a total of six cards in his hand. The next player in sequence will then take his turn, playing either cards from his hand or from the common card pool.

When a card is played from a player's hand, it is placed on top of the last card from the card pool that the player has played, thereby eliminating that card pool card from subsequent play. The card from the player's hand then replaces that original card pool card, and is available for play. If the player playing the card from his hand has not previously played a card from the common card pool during his turn, the player's hand card can be placed upon any one of the six common card pool cards currently exposed.

Play continues, turn by turn, until one player has covered all of the spaces on his individual game board. At this time, the player, having covered all of his spaces, may select a card from the secondary deck. This secondary deck is utilized to determine if the player, who has covered all of the spaces in his board, has won the current round. In order to win a round, the player, after successfully covering all of his spaces, must select a card from the secondary deck upon which the proper indicia, indicating conclusion of the current round, appears.

The remaining cards in the secondary deck have indicia which correspond to one or more of the spaces on a playing board. The player, drawing one of these cards, must remove the chips covering corresponding spaces on his individual board. In this event, the current round is not concluded, and play continues with the player next in sequence.

A player, at the beginning of his turn, may elect to make one of two alternate moves. The player's first option is to discard two of the cards, currently held in his hand, onto the common card pool. The player may then draw two new cards from his individual card pool. The second option open to the player is to discard one card from his hand, and/or to move one of his chips already on the board to cover an adjacent, previously uncovered space.

Scoring is only accomplished at the end of a round, and is determined by the number and face value of the cards held by the player who has won the round and those held by his opponents, as well as the number of spaces left uncovered by the opposing players.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF PREFERRED EXEMPLARY EMBODIMENTS

Figure 4:
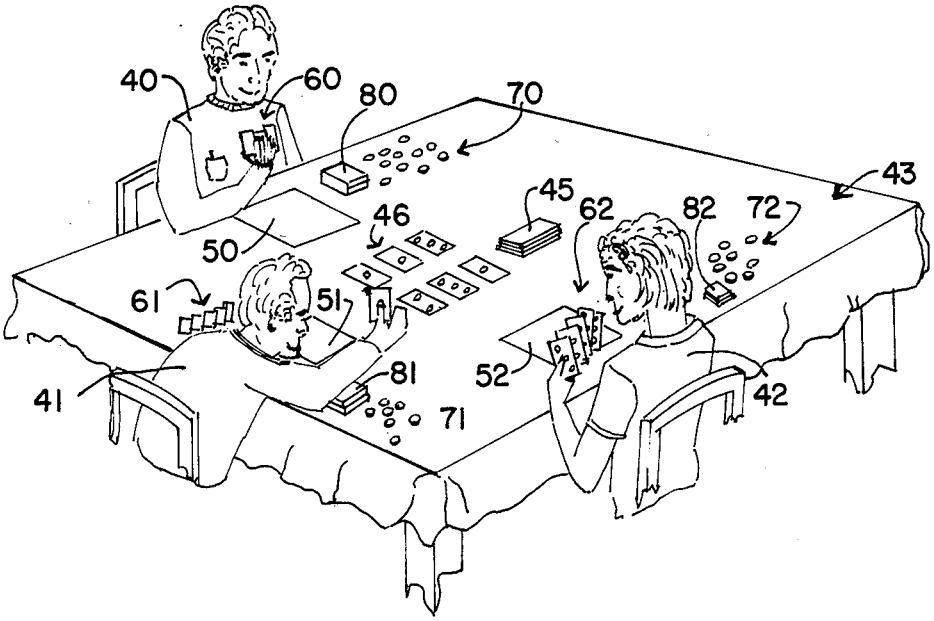
FIG. 4 is a perspective view of a gaming table configured for play of the present invention by three persons.

The preferred embodiments described herein utilize three players for the purpose of illustration. The three players, 40, 41 and 42, are seated around a common playing table, 43 as illustrated in FIG. 4. Each of the players, 40, 41 and 42 has his own board, 50, 51 and 52, respectively. Each player also has a set of cards which make up his hand, 60, 61 or 62. A secondary deck, 45, is shown on the table next to the common card pool, 46. The primary deck has been distributed into individual card pools, 80, 81 and 82, and the common card pool, 46.

The common card pool, 46, begins as six cards from the primary deck and during play consists of any number of cards, six of which lie face-up and exposed for play. The remaining cards of the common card pool are covered by the top exposed cards. Each player in his turn can utilize any of the exposed cards of the common card pool, 46, and in playing, the next card utilized by that player, covers that card. The original six cards making up the common card pool come from the primary deck. The subsequent cards are added to the pool as they are played from each of the hands, 60, 61 and 62.

Each player also has a pile of chips, 70, 71 and 72. The chips are utilized to cover the appropriate spaces on the player's board, 50, 51 or 52.

Figure 1:
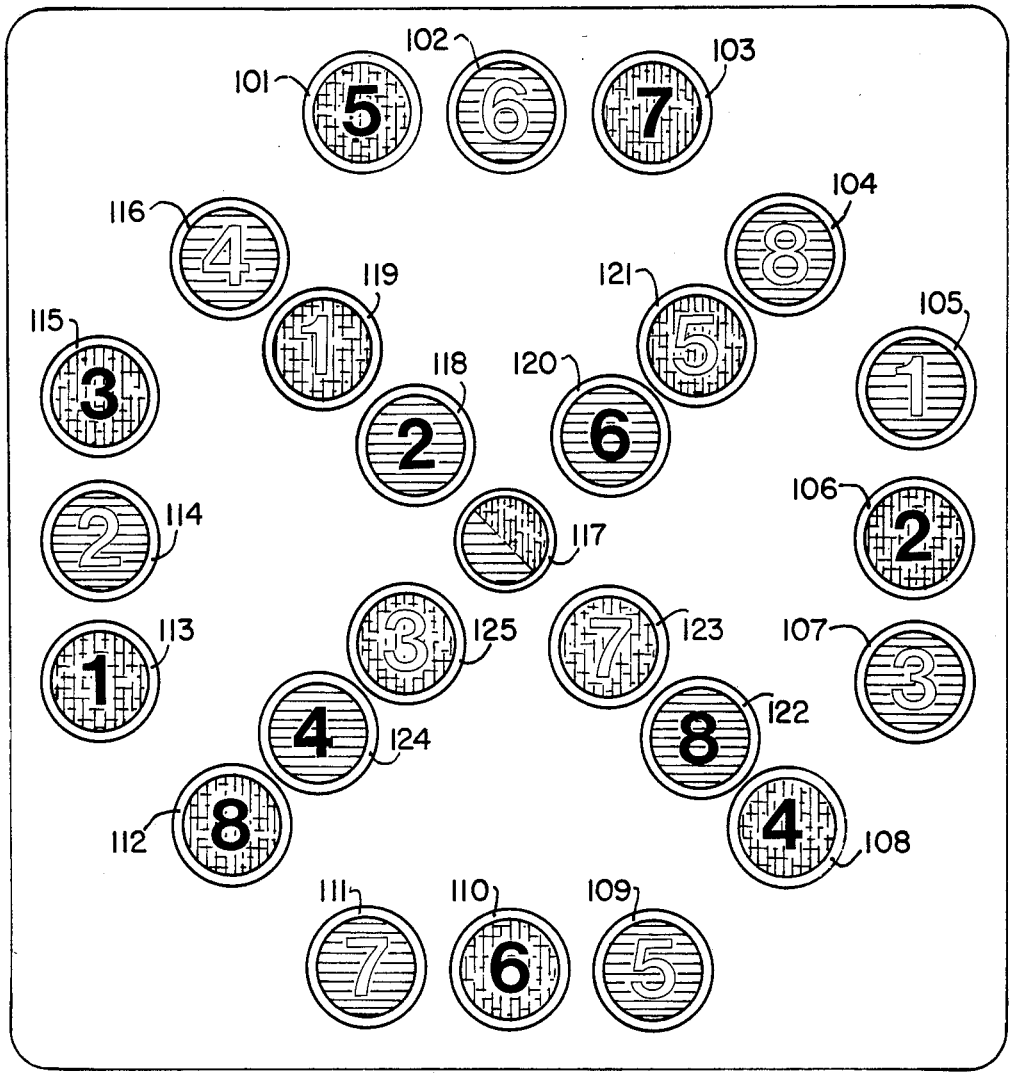
FIG. 1 is a top view of one preferred embodiment of an individual game board of the present invention.
Figure 5:
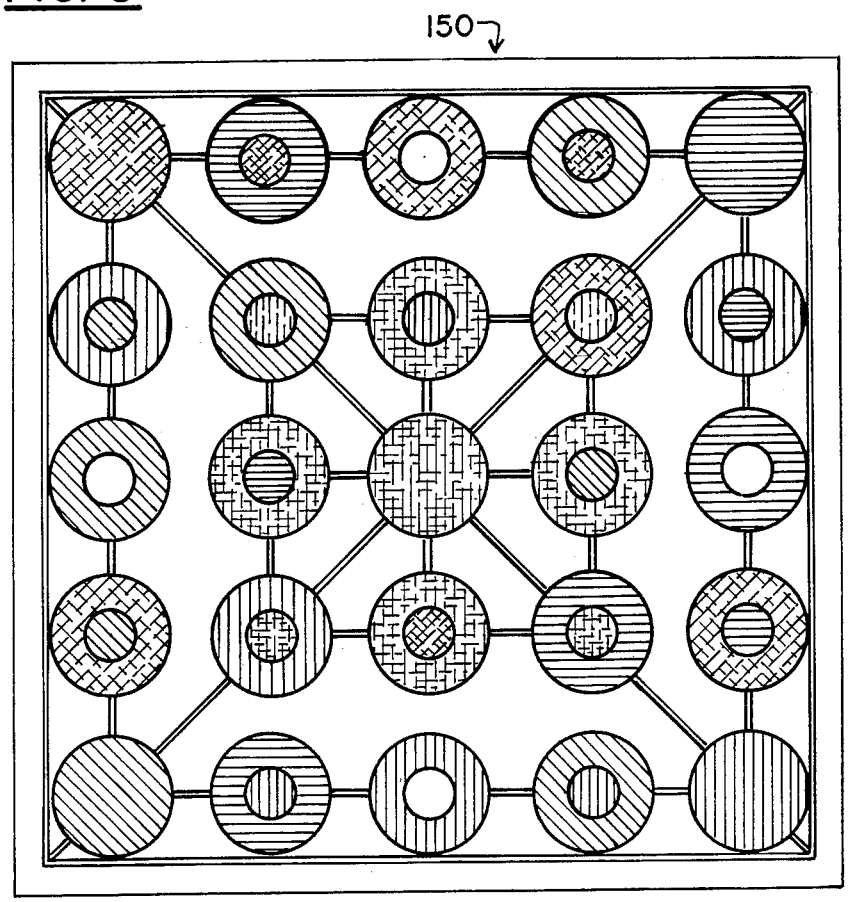
FIG. 5 is a top view of an alternative preferred game board, utilizing only colors for individual space identification.
Figure 6:
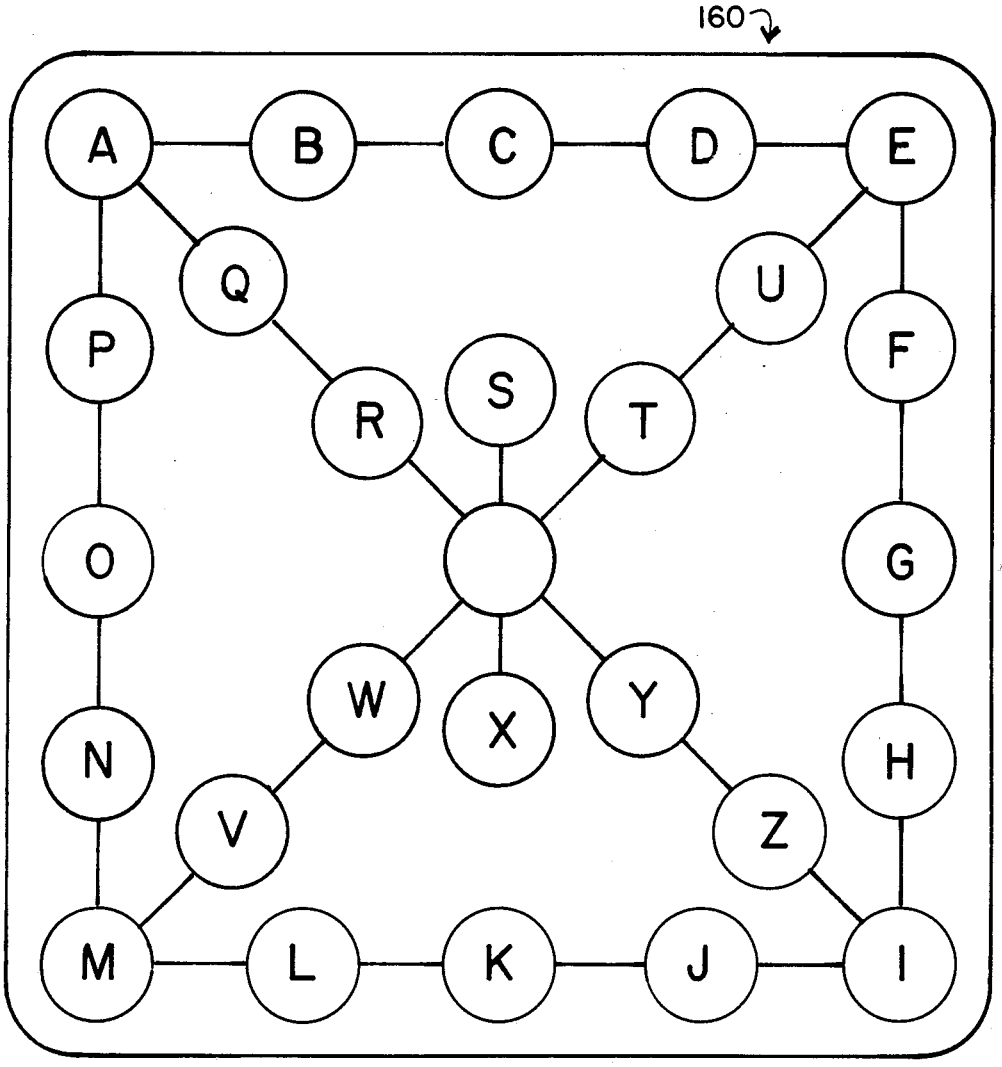
FIG. 6 illustrates a further alternative embodiment for a game board of the present invention.
Figure 7:
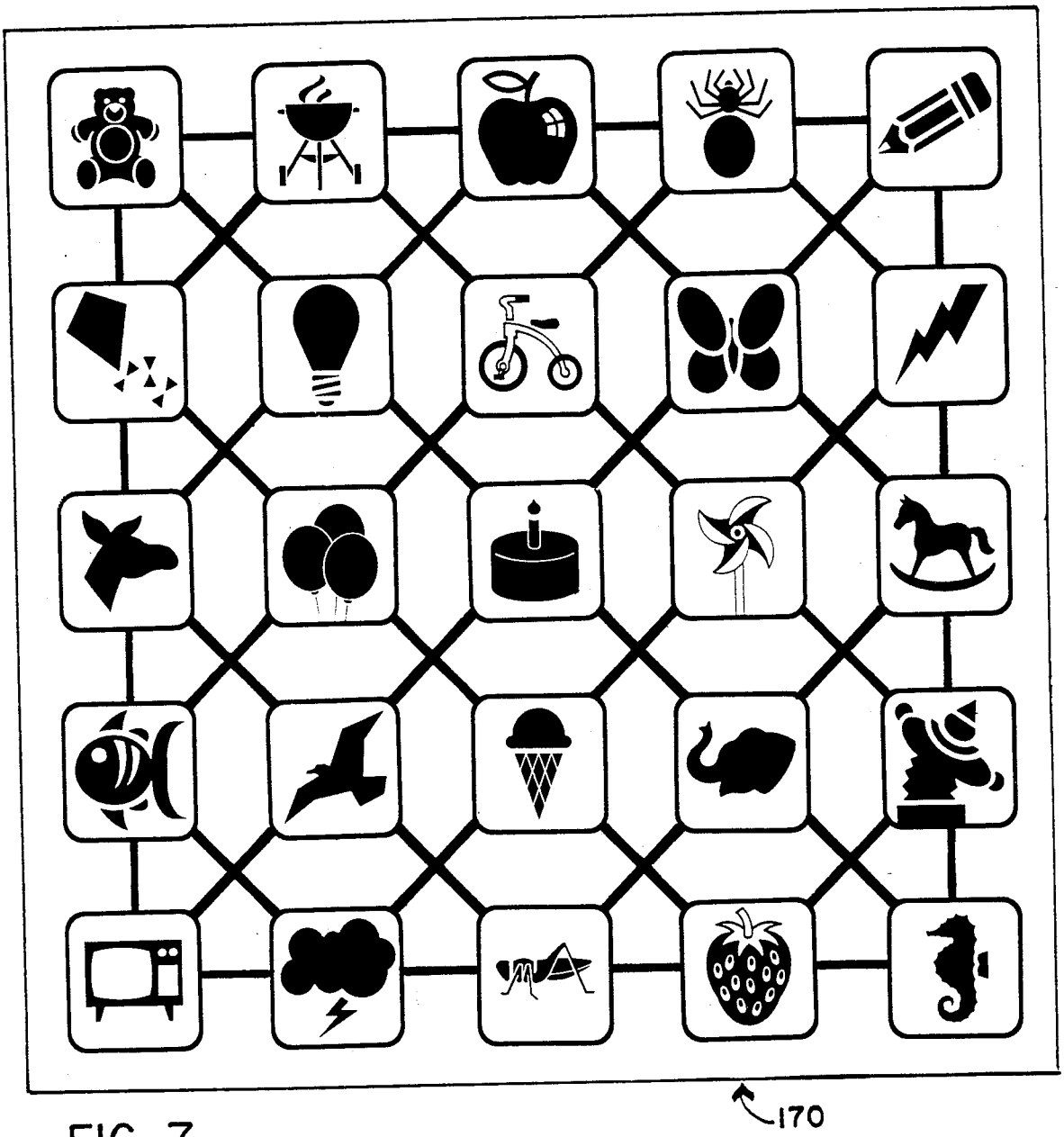
FIG. 7 illustrates a further alternative embodiment for a game board, to be utilized within the teachings of the present invention.

Each of the boards, 50, 51 and 52 is identical, and can take any of the exemplary forms illustrated in FIGS. 1, 5, 6 or 7. FIG. 1 illustrates one preferred exemplary embodiment of a playing board 100 for the present invention, wherein the spaces on the board are distinguished by number and color identifications. FIGS. 5, 6 and 7 illustrate alternative embodiments of playing boards for the present invention, wherein numbers are excluded and the different spaces of the board are color, letter or picture coded for differentiation.

Figure 2:
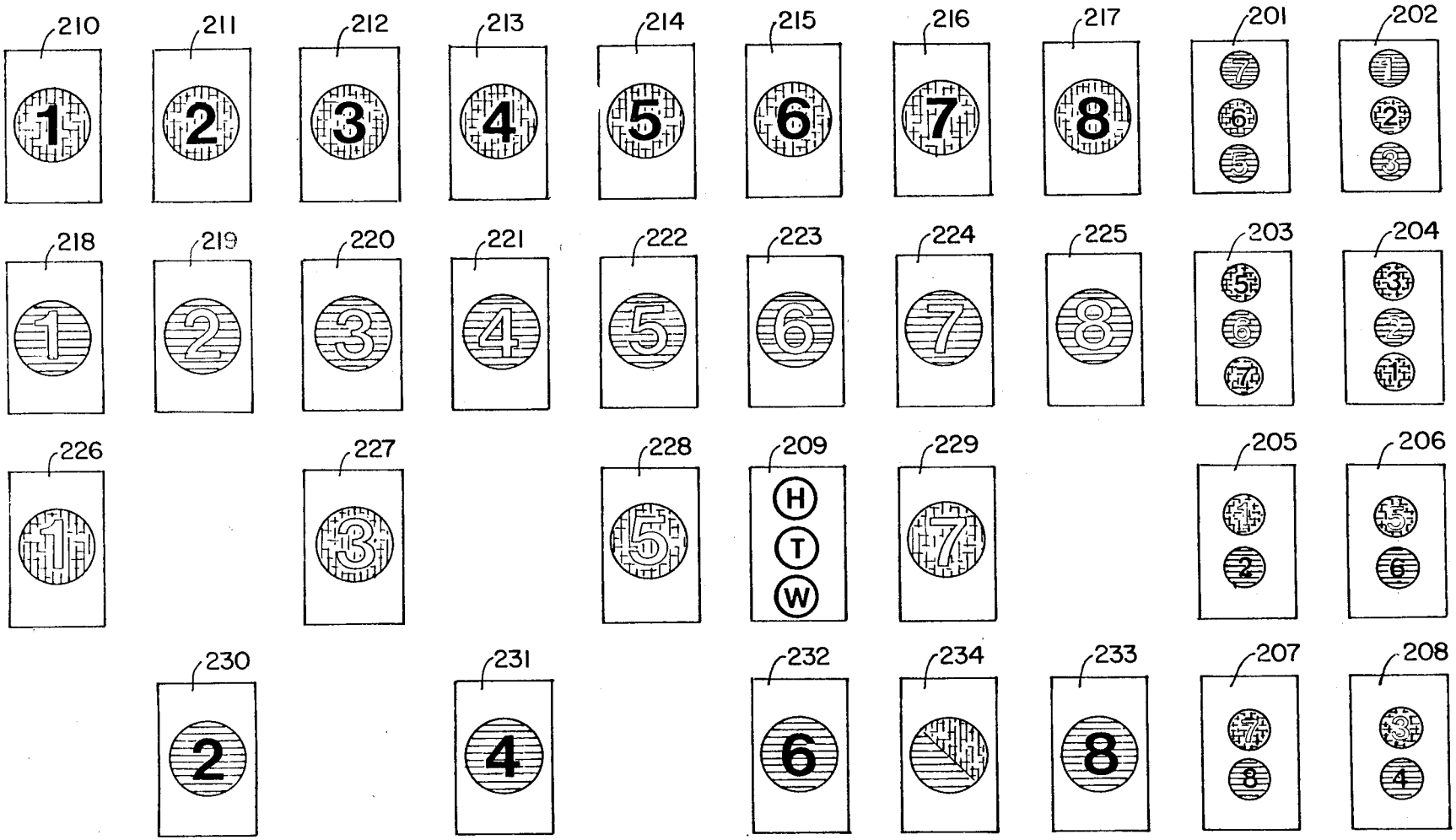
FIG. 2 illustrates the 34 possible different faces for the cards contained within a 128 primary card deck.

FIG. 2 illustrates the various front face indicia of the cards of the primary deck, which correspond to the spaces of the playing board, illustrated in FIG. 1. There is correspondence between the indicia on the front face of the cards of FIG. 2 and the indicia contained within the spaces of the boards illustrated in FIGS. 1. When cards from the deck illustrated in FIG. 2 are utilized for play, indicia on the front face of the cards indicate where to position a covering marker on the board. The cards in the card pool, 46, are also supplied from the primary deck of FIG. 2.

Figure 3:
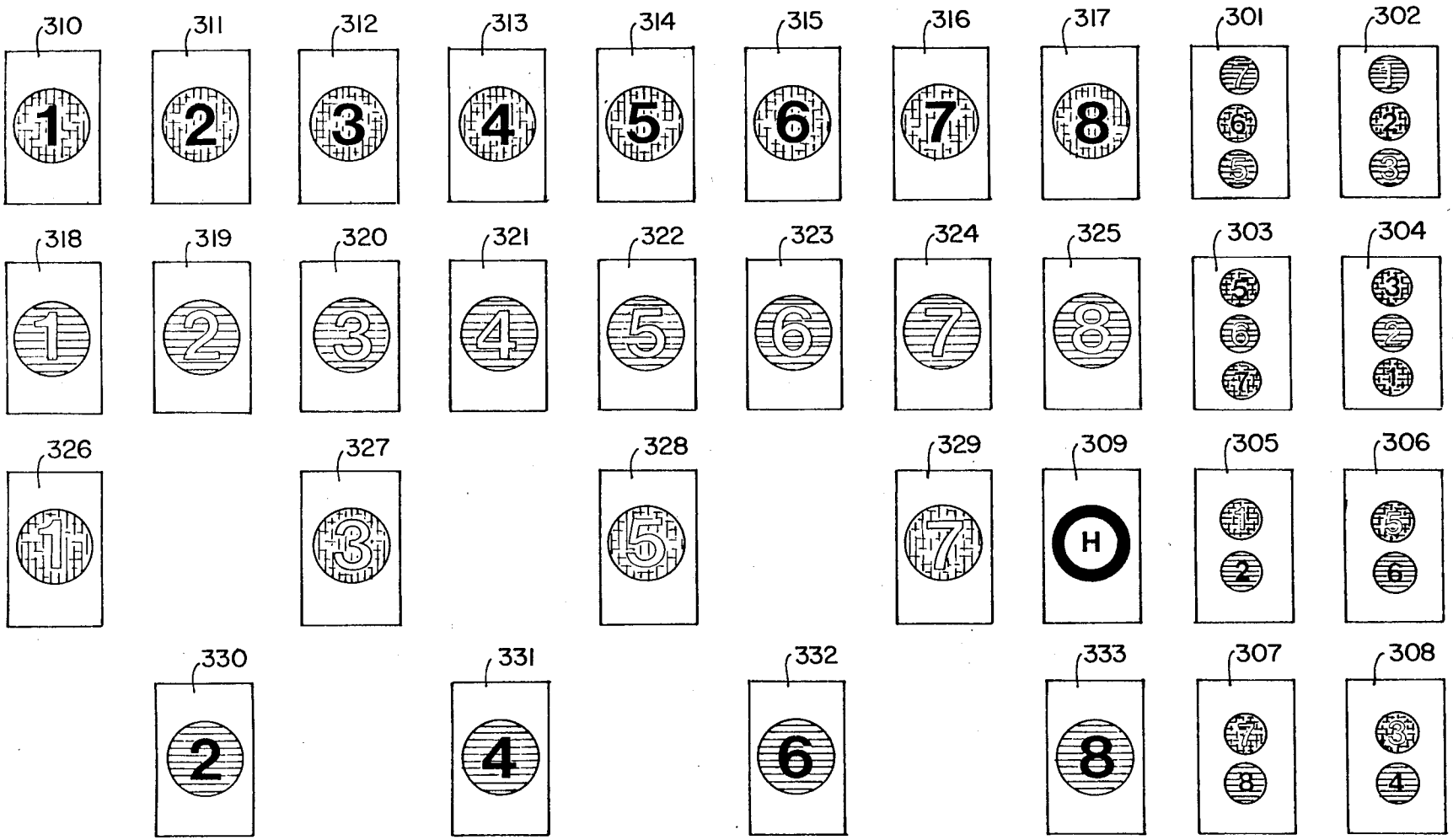
FIG. 3 illustrates the 42 cards which make up a secondary card deck.

The secondary deck, 45, FIG. 4, is comprised of cards as illustrated in FIG. 3. Seventy-six percent of the cards in the secondary deck have indicia corresponding to the indicia contained on the spaces of the playing board. The remaining b 24% of the cards in the secondary deck have distinctive indicia indicating the end of a round, printed on the front face thereof. These cards indicate that the player drawing such a card, after covering all of the spaces on his respective board, has won that round of the game. When one of these cards is drawn, the time has come to total the points accumulated during the round. It is then time to clear off all boards and redistribute the cards for a subsequent round, until all rounds making up an entire game have been completed.

The playing board 100, as illustrated in FIG. 1, which is representative of the first embodiment of any one of the boards, 50, 51 and 52 of FIG. 4, is comprised of twenty-five spaces arranged in a continuous pattern. The spaces have alternating blue or gold backgrounds with white or black numerals thereon. The spaces of the outer octagon are comprised of alternating black numerals on gold background with white numerals on a blue background. The internal diagonals are comprised of white numerals on a gold background, alternated with black numerals on a blue background. The central circle 126 has no numeral and is comprised of a half-blue, half-gold background.

Any color designation of the spaces of the playing board 100, as illustrated in FIG. 1, can be utilized in keeping with the teachings of the present invention. Blue, gold, black and white are shown here for illustrative purposes only. The numerals, used to further designate the particular spaces of the playing board, are also shown only for illustrative purposes. Any designation system, utilizing any numerals, letters, pictures or colors alone can be used distinctively to mark individual spaces on a playing board, still keeping within the teachings of the present invention.

A typical playing board 100 for the first preferred embodiment, as illustrated in FIG. 1, can be divided into several zones. An experienced player will learn the strategic significance of these zones and will benefit from his ability to seek to cover desired areas in an advantageous sequence. The board is first divided into an outer octagon comprised of sixteen individual spaces 101–116 and a set of four inner diagonals of two spaces each with a central space 117. With the board 100 oriented so that the numerals are upright, the twelve spaces which comprise the two horizontal and two vertical sides of the octagon are referred to as triples. The first triple is comprised of spaces 101, 102 and 103; the second triple is comprised of spaces 105, 106 and 107; the third triple is comprised of spaces 109, 110 and 111; and the fourth triple is comprised of spaces 113, 114 and 115. The remaining four spaces 104, 108, 112 and 116 are referred to as the linking spaces. These spaces link the outer octagon with the inner diagonals and the central space 117. Each of the four inner diagonals is comprised of a designated double. The first double is comprised of spaces 118 and 119; the second double of 120 and 121; the third double of 122 and 123; the fourth double of 124 and 125.

The spaces on the board 100, illustrated in FIG. 1, can be described as follows, beginning with space 102 and moving clockwise around the outer octagon. The top central space 102 is a white numeral on a blue background. The next space 103 is a black numeral on a gold background. Next 104, white on a blue background, then 105 white on a blue background, 106 black on a gold background, 107 white on a blue background, 108 black on a gold background, 109 white on a blue background, a 110 black on a gold background, 111 white on a blue background, 112 black on a gold background, 113 black on a gold background, 114 white on a blue background, 115 black on a gold background, 116 white on a blue background, and finally 101 black on a gold background.

The spaces of the outer octagon are numerically and color-coded as to provide a means for distinctive and easy recognition of correspondence between playing cards and board spaces by an experienced player. The spaces of the inner diagonals are also numbered and colored to provide the same ease of correlation recognition. The odd numbers on the diagonals, 119, 121, 123 and 125 are white numerals on gold backgrounds. The even-numbered spaces 118, 120, 122 and 124 are black numerals on a blue background. The central space of the board 117 contains no numeral and is comprised of a half-blue, half-gold circle.

The spaces of board 150, illustrated in FIG. 5, have no distinctive indicia such as the numerals of board 100, illustrated in FIG. 1. The spaces are distinguished from one another solely on the basis of color. The spaces of board 150 are arranged in a continuous pattern, different from that of board 100, and therefore, providing a different pattern of play. The spaces of boards 160 and 170 of FIGS. 6 and 7 are also arranged in still other patterns to provide further alternate patterns of play.

Primary and secondary decks with appropriate indicia corresponding to the spaces of the particular board are utilized for play with boards 150, 160 and 170. The decks for play with board 150 would have indicia distinguished by color. The decks for board 160 would have alphabet indicia, and the decks for board 170 would have picture indicia corresponding to the pictures on board 170.

It can be seen from the 34 cards illustrated in FIG. 2 that the indicia on the front face of the cards corresponds to the indicia on the spaces of the board illustrated in FIG. 1. Twenty-five of the illustrated card faces have a direct one-to-one correlation with the 25 spaces of the game board. There are nine further cards which do not have a direct one-to-one correlation with a single space on the board. These nine cards, 201–209, are referred to as doubles, triples and triple wild cards. The indicia contained on the face of each of these cards correspond to more than one of the spaces on the game board. When one of these cards is played, the player can cover a number of spaces at a time. The player need not be able to cover all the spaces represented on the face of the card being played. He may choose to play one or more spaces at his discretion. The triple wild card, 209, allows covering of up to any three spaces which lie in a straight line.

The primary card deck, FIG. 2, may consist of any total number of cards. In the embodiment illustrated herein, wherein three players are utilized for illustrative purposes, the primary deck consists of 128 cards. If more players are playing simultaneously, a board is necessary for each player, and the primary deck may consist of a correspondingly greater number of cards. There should be approximately 20 more cards for each additional player. The ratio of the cards in the primary deck will remain the same. The ratio is detailed herein for a deck having a total of 128 cards for utilization by three players at a time.

In a primary deck of a total of 128 cards, cards 210–234, illustrated in FIG. 2, are repeated four times each. Cards 201–208 are repeated twice each. Card 209 occurs twelve times in the 128 card primary deck. This provides ratio wherein, in a primary deck having four of each single indicia card, the deck must also contain two of each triple indicia card and two of each double indicia card, as well as twelve triple wild cards. By maintaining this ratio of cards, each space on the board is exactly duplicated by the indicia on the card face six times, except for the linking spaces 104, 108, 112 and 116 and the central space 117 which are only represented 4 times. This does not include any optional duplication through the utilization of triple wild cards. The six specific opportunities to fill each individual space and the four possible for the linking and central spaces, along with the twelve wild opportunities, allow for a smoothly-paced game while providing enough instances wherein a player is unable to cover a space, to make the game continual-paced and challenging.

The indicia on cards 210–217 are black numerals on gold circles, and correspond to half of the spaces comprising the outer octagon of the game board. The indicia on cards 218–225, white numerals on blue circles, correspond to the remaining spaces of the outer octagon of the game board.

The indicia on cards 201–204 correspond to the horizontal triples at the top and bottom of the outer octagon of the game board and the vertical triples of the left and right sides of the outer octagon of the game board. The indicia on the four doubles cards 205–208 correspond to the eight individual spaces comprising the four central diagonal doubles of the game board.

The indicia on cards 226–229, white numerals on gold circles, correspond to four of the individual spaces of the central diagonals of the game board. The indicia on cards 230–233, black numerals on blue backgrounds, correspond to the remaining spaces of the central diagonals of the game board. The indicia on card 234, a half-gold, half-blue circle, corresponds to the central space on the game board. The indicia on the face of the triple wild card, 209, does not correspond to any specific designated spaces of the playing board. This wild card can be utilized when covering one, two or three spaces which lie in any straight line.

The secondary card deck, illustrated in FIG. 3, will always be comprised of forty-two cards, regardless of the number of players. The 33 different cards of the secondary deck are illustrated in FIG. 3. The remaining nine cards are duplications of the Hesitation "win" card, 309. Therefore, for every single occurrence of the thirty-two "continue" cards, which correspond to specific spaces on the game board, there are ten occurrences of the Hesitation "win" card, 309. The Hesitation card, 309, is the card which, when drawn, indicates that the player drawing this card has won the current round. Therefore, through the multiple occurrence of this card within the secondary deck, it is ten times as likely that a player will draw a round-winning card than any other single card, but only a 24% chance that the player drawing a card from the secondary deck will win the particular round.

The typical procedure of play, utilizing boards as illustrated in FIG. 1 and cards as illustrated in FIGS. 2 and 3, will be described herein, with reference to a three-player situation. Three players, 40, 41 and 42, as illustrated in FIG. 4, are seated around a common table, 43. One player is selected at random to be the dealer, for example, player 41. The primary and secondary decks are both independently shuffled. The secondary deck, 45, is placed in a pile accessible to all players. The dealer, 41, then begins to distribute the cards of the primary deck.

The first six cards of the primary deck are placed face up in a central location on the table to form the common card pool, 46. The remaining cards of the primary deck are then dealt to the three players to form the individual card pools, 80,81 and 82. All of the cards of the primary deck are distributed, even though the individual card pools may differ by one card, more or less. Each player then draws the top six cards from his individual card pool to form the players' individual hands, 60,61 and 62. This round of the game is then ready to commence with the first turn.

The object of each round is for an individual player to attempt to cover all the spaces on his board before his opponents are able to cover all the spaces on their boards, and to draw a winning card from the secondary deck. Upon completion of a round, points are awarded to that player who successfully covered all of the spaces on his board, and then successfully drew a winning card from the secondary deck. The object of the game is to accumulate a pre-established number of points through winning points at the completion of each round. The game can also be played for a predetermined number of rounds, whereby the individual who has accumulated the greatest number of points at the end of the desired number of rounds is the winner of the game, which consists of the set number of rounds.

The game begins with the player to the dealer's left, player 40, having the first turn. A player may attempt to cover as many or as few spaces as desired on his board during any particular turn. In order to cover spaces on his board, the player must utilize cards from the common card pool, and, or cards from his hand, which correspond to uncovered or open spaces on his game board. If there are no cards in the common card pool, 46, or in the player's hand, which correspond to open spaces on the individual's board, the player need not forfeit his turn, but may instead choose to utilize his turn through one of two optional moves.

If player 40 desires to play cards both from the common card pool, 46, and from his hand, 60, on a single turn, he must first play those cards he desires from the common card pool 46, and then subsequently play cards from his hand, 60. A player may start off by utilizing any available card to cover any open space he desires. If the player wishes to play subsequent cards, they must correspond to spaces adjacent a space covered during the same turn or connected to such a space by previously-covered spaces. When the player's next turn arises, he need not play open spaces which are adjacent or connected to spaces covered on his previous turn.

In order to play a card from the common card pool, 46, the player, 40, need only indicate the card he is utilizing, and then place a chip from his chip pool, 70, upon the corresponding space upon his game board, 50. The player can continue in this manner, utilizing cards from the common card pool, until he no longer recognizes open connecting spaces left to cover. At this point, the player may begin to utilize the cards in his hand, 60, to continue to cover open connecting spaces. In order to utilize cards from his hand, 60, the player, 40, must remove the desired card from his hand and place it on top of the last utilized card from the common card pool, 46. The player, 40, places this card from his hand, 60, face up, covering the previous card in the card pool, 46. In this manner, the card from the card pool, 46, which has been covered, is no longer available for play during subsequent turns by any player. However, the card utilized from the player's hand, 60, is now available for utilization by any player. Once player 40 no longer chooses to cover connecting open spaces, he will indicate that his turn is up by replenishing his hand, 60, from his individual card pool, 80. He may only replenish his hand, 60, up to a total of 6 cards in his hand, 60. At this time, it is now the turn of the next player, 42.

Player 42 will exercise a turn in the same manner as that described for player 40. Upon completion of her turn, she may replenish her hand from her individual deck, 82, up to a total of 6 cards. Play then proceeds to player 41, who will exercise the options available to him during his turn, upon completion of which he will replenish his hand as desired, and it will be the turn of player 40 again.

Play continues in this manner, turn by turn, until one of the players has covered all of the spaces on his game board.

A player, at the start of any turn, has the option of exercising one of two optional plays. His first option is to discard two cards from his hand, and place them in any desired location within the common card pool. His second option is to move a single game board chip, which has already been placed on his board, to an adjacent open space. In this manner, the player will cover a previously-uncovered space, but will now open a previously-covered space. In combination with this single chip move, the player may also discard a single card to any desired location in the common card pool. Alternatively, the player may elect to move a single chip or discard a single card.

If any player exhausts all of the cards from his individual card pool before the end of a round, then all of the cards, except the 6 top face-up cards of the common card pool, 46, are shuffled and then redistributed to all players to replenish each individual's card pool. The top 6 face-up cards of the common card pool, 46, remain in their previous locations for subsequent play.

Once an individual has covered all the spaces on his individual game board, he may choose to draw immediately a card from the secondary card deck, or to wait and discard cards up to two at a time during his subsequent turns, until such time as he desires to draw a card from the secondary deck. The secondary deck, 45, as illustrated in FIG. 3, contains 10 "win" cards, 309, having a single circle with an "H" in the center. These cards designate the end of a round when drawn. The remaining 32 "continue" cards in the secondary deck have indicia printed on the front face thereof, which correspond to one or more spaces on the game board.

If the player, drawing from the secondary deck, draws a card having the indicia shown on card 309, then this draw indicates that the player has won the round. In this instance, scoring of the round is commenced. If, however, the player draws one of the other 32 cards from the secondary deck, the round is not completed. The player drawing such a card must remove the chip or chips which cover the corresponding spaces on his individual game board. Once the chips have been removed from the player's individual board, play continues as before with the turn of the next player.

When a round-winning card is drawn from the secondary deck, scoring in the preferred exemplary embodiment is commenced as follows. The player who has completed the round by covering all the spaces on his board receives 10 points. This same player also receives points for the cards remaining in his opponents' hands, and deducts points for cards remaining in his own hand. For each card having one circle, the player either adds or deducts one point. For each double circle card the player adds or deducts two points. For each triple circle card the player adds or deducts three points. For each triple wild card, the player adds or deducts five point.

In an alternative scoring embodiment, the player may also add or deduct points based on the spaces left open on his opponents' individual boards.

Once the round is finished and scoring is completed, all the cards are reshuffled into two decks, and the game boards are cleared of all chips. The cards of the primary deck are then redistributed as described above, and the next round commences. Play continues, round by round, until the desired number of pre-determined rounds have been completed, or until one player amasses the pre-determined number of points, indicating victory of the game.

As mentioned above, experience will aid a player in utilizing the game board and cards to his advantage in a strategic manner. A player will learn the frequency of occurrence of certain cards in relation to the occurrence of other cards and will learn the strategic significance of covering certain spaces on the game board. A player will also realize that he needs to keep track of specific blank spaces on his opponents' game boards, as well as the sequence and placement of cards into the common card pool.

A player will realize that the best play is to cover the most desirable cards in the common card pool and to play the less desirable cards at the end of his turn, to prevent his opponents from utilizing the more desirable cards. For instance, triple wild, triple and double cards are generally more desirable than single space cards, and, therefore, should not be left accessible at the end of a player's turn. However, linking spaces which can be utilized to move from the outer octagon to the inner diagonals or vice versa, which only occur four times in the primary deck, are also very valuable cards.

An experienced player will also give consideration to his cards and their face value, as well as to other players' cards and their face value and the spaces remaining open on other players' boards, prior to drawing a card from the secondary deck after filling the spaces on his board. Depending on the scoring method utilized, a player can be either penalized or rewarded for spaces remaining open on opponents' boards and for cards held in his hand and in the opponents' hands. Therefore, an experienced player will utilize his optional turns to discard cards from his hand when it is prudent to do so, considering the possibility of his opponents completely covering the spaces on their boards. A player must, therefore, weigh the risks and potential gains when determining whether or not to wait before drawing from the secondary deck. The player must also make strategic considerations in using optional turns to move markers onto more desired spaces from adjacent less desired spaces. The present invention, therefore, teaches a game which relies both on skill and luck, provides the development of strategic skills, as well as number and color matching and recognition techniques.

Because many varying and different embodiments may be made within the scope of the inventive concept herein taught, and many modifications may be made in the embodiments herein detailed in accordance with the descriptive requirements of the law, it is to be understood that the details herein are to be interpreted as illustrative, and not in a limiting sense.

Once given the above disclosure, many other features, modification and improvements will become apparent to the skilled artisan. Such features, modifications and improvements are thus to be considered a part of this invention, the scope of which is to be determined by the following claims:

I claim:

1. Apparatus for a game comprised of at least one round, each round comprised of at least one turn; comprising;

a plurality of playing boards, a continuous pattern of uniquely identifiable spaces on each of said boards, a first deck of playing cards, including cards having indicia thereon corresponding to at least one of said spaces, and further including cards having indicia corresponding to the indicia on a plurality of adjacent spaces, said indicia on said first deck of cards directing the covering of the spaces on the boards having corresponding indicia, a second deck of playing cards including "continue" cards having indicia thereon corresponding to at least one of said spaces, and "continue" cards having indicia corresponding to the indicia on a plurality of adjacent spaces, said indicia on said "continue" cards directing the uncovering of spaces having corresponding indicia, said second deck further including at least one "win" card having indicia indicative of round termination, and means for selectively covering individual spaces of said boards.

2. The game apparatus of claim 1, wherein:

said spaces are distinguished by unique numerical and color composition.

3. The game apparatus of claim 2, wherein:

said continuous patterns are comprised of twenty-five individual spaces, said first deck is comprised of one hundred and twenty-eight cards, and said second deck is comprised of forty-two cards.

4. The game apparatus of claim 1, wherein:

said spaces are distinguished by unique color composition.

5. The game apparatus of claim 4, wherein:

each space is comprised of a unique combination of at least two colors, wherein:

each of said colors is found on other spaces of said board.

6. The game apparatus of claim 1, wherein:

said spaces are distinguished by unique alphabet character designation.

7. The game apparatus of claim 1, wherein:

said spaces are distinguished by unique pictorial representation.

* * * * *